US008276924B2

(12) United States Patent
Kim

(10) Patent No.: US 8,276,924 B2
(45) Date of Patent: Oct. 2, 2012

(54) GOLF BAG CARRIER

(75) Inventor: Jung Han Kim, Seoul (KR)

(73) Assignee: King Tiger Corp., Seoul (KR)

( * ) Notice: Subject to any disclaimer, the term of this patent is extended or adjusted under 35 U.S.C. 154(b) by 109 days.

(21) Appl. No.: 12/809,753

(22) PCT Filed: Jan. 5, 2009

(86) PCT No.: PCT/KR2009/000026
§ 371 (c)(1),
(2), (4) Date: Jun. 21, 2010

(87) PCT Pub. No.: WO2009/088187
PCT Pub. Date: Jul. 16, 2009

(65) Prior Publication Data

US 2010/0276911 A1 Nov. 4, 2010

(30) Foreign Application Priority Data

Jan. 9, 2008 (KR) ..... 10-2008-0002612

(51) Int. Cl.
*B26B 1/12* (2006.01)
*B26B 1/14* (2006.01)

(52) U.S. Cl. ..... 280/47.26; 280/47.27; 280/47.29; 280/652

(58) Field of Classification Search .... 280/47.26–47.29, 280/652
See application file for complete search history.

(56) References Cited

U.S. PATENT DOCUMENTS 2,855,208 A * 10/1958 Abgarian ..... 280/646
3,195,844 A * 7/1965 Roepke ..... 248/96
3,433,497 A * 3/1969 Leitzel ..... 280/40
2005/0236025 A1 * 10/2005 Gale et al. ..... 135/74
* cited by examiner

*Primary Examiner* — Jeffrey J Restifo
*Assistant Examiner* — Erez Gurari
(74) *Attorney, Agent, or Firm* — Design IP

(57) ABSTRACT

A golf bag carrier comprising a vertical bar, foldable wheels installed on the vertical bar; a fixing band installed on the vertical bar to fix the golf bag, a supporting plate that is coupled to a lower end of the vertical bar such that it is unfolded when the golf bag is loaded thereon and folded when the golf bag is unloaded therefrom, a first support that is fixed at an upper portion of the vertical bar to support the golf bag, an elevating bar that is coupled to an upper end of the vertical bar by a height adjusting unit, and a second support that is installed to support an upper end of the golf bag.

20 Claims, 4 Drawing Sheets

GOLF BAG CARRIER

CROSS REFERENCE TO RELATED APPLICATIONS

This application is the National Stage of International Application No. PCT/KR2009/000026, filed Jan. 5, 2009, which claims the benefit of Korea Application No. KR 10-2008-0002612, filed Jan. 9, 2008, which is incorporated herein by reference in its entirety as if fully set forth.

TECHNICAL FIELD

The present invention relates to a golf bag carrier, and more particularly, to a golf bag carrier on which a golf bag can be more easily loaded and unloaded and which can stably support the golf bag when it stands on the ground and minimize occupation of a space when it is stored.

BACKGROUND ART

Generally, most of the golfers play golf with a golf bag carrier such as a golf bag cart or with a caddy. The golf bag carrier is designed such that it is small and can stably carry the golf bag.

Korean Utility Model Registration No. 0382231 discloses such a golf bag carrier. As shown in FIG. 7, the golf bag carrier of this utility model includes a vertical rod 51 on which a handle 50 is formed, a supporting plate 52 on which a golf bag is disposed and which is fixed to a lower end of the vertical rod 51, and a foldable supporting rod 54 which is installed on a middle portion of the vertical rod 51 and to which wheels 53 are installed.

A length of the vertical rod 51 is adjustable. After the golf bag B is disposed on the carrier, the golf bag B is fixed by a fastener such as a belt (not shown) and the user moves the carrier with his/her hand grasping the handle 50 in a state where the carrier is inclined by a predetermined angle.

After moving the carrier, the user stops and stands the carrier and unloads the golf bag to play golf.

DISCLOSURE OF INVENTION

Technical Problem

However, the carrier designed as described above has a problem in that, when it is intended to keep the carrier after using the carrier, since the supporting plate protruded frontward, a space occupied by the carrier is unnecessarily enlarged and thus it is inconvenient to keep the carrier.

In addition, when the carrier stands, the supporting plate contacts the ground and thus a lower portion of the supporting plate is polluted. It is troublesome to clean the supporting plate after playing golf.

Accordingly, the present invention has been made in an effort to solve the above-described problem. It is an object f the present invention to provide a golf bag carrier that is designed to stably stand on the ground and to minimize an occupying space when it is kept.

Technical Solution

To achieve the object, the present invention provides a golf bag carrier including a vertical bar, wheels that are installed on the vertical bar to be capable of being folded, a fixing band that is installed on the vertical bar to fix the golf bag, a supporting plate that is coupled to a lower end of the vertical bar such that it is unfolded when the golf bag is loaded thereon and folded when the golf bag is unloaded therefrom, a first support that is fixed at an upper portion of the vertical bar to support the golf bag, an elevating bar that is coupled to an upper end of the vertical bar by a height adjusting unit, and a second support that is installed to support an upper end of the golf bag.

Advantageous Effects

According to the embodiment, when the golf bag is loaded on the carrier, the supporting plate does not contact the ground but is horizontally maintained. Therefore, the pollution of the cart can be prevented. Furthermore, since the supporting plate is folded when keeping the carrier, the carrier can be efficiently kept in a small space.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
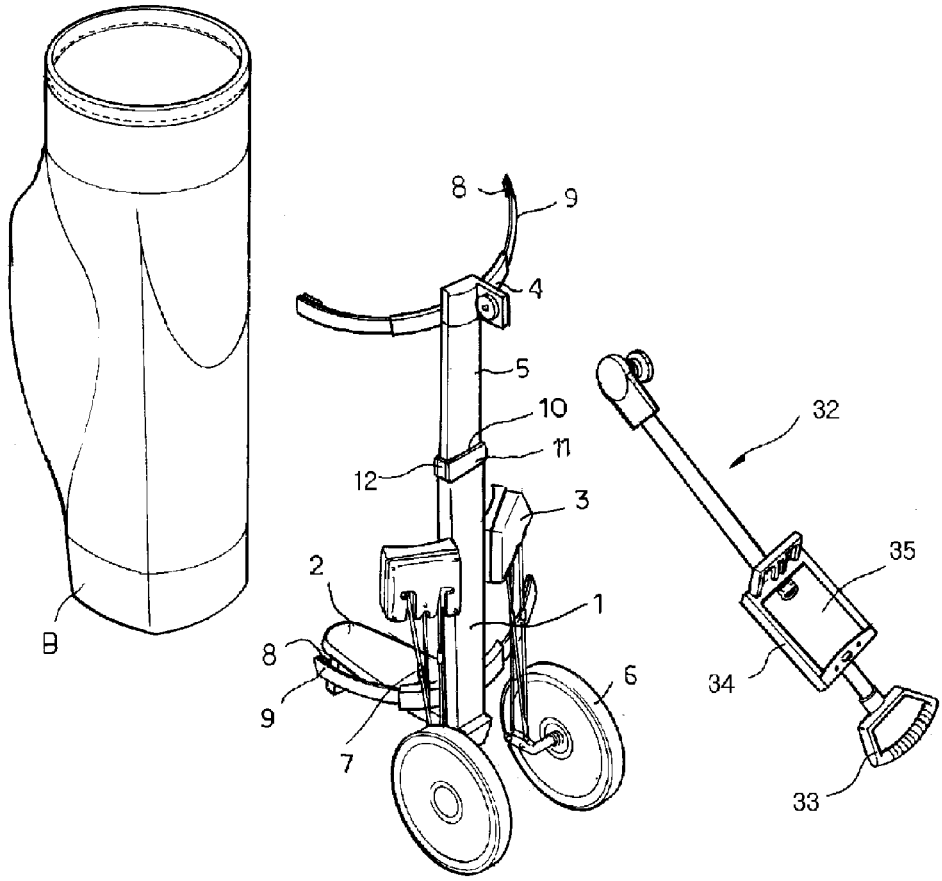
FIG. 1 is a perspective view of a golf bag carrier according to an embodiment of the present invention.
Figure 2:
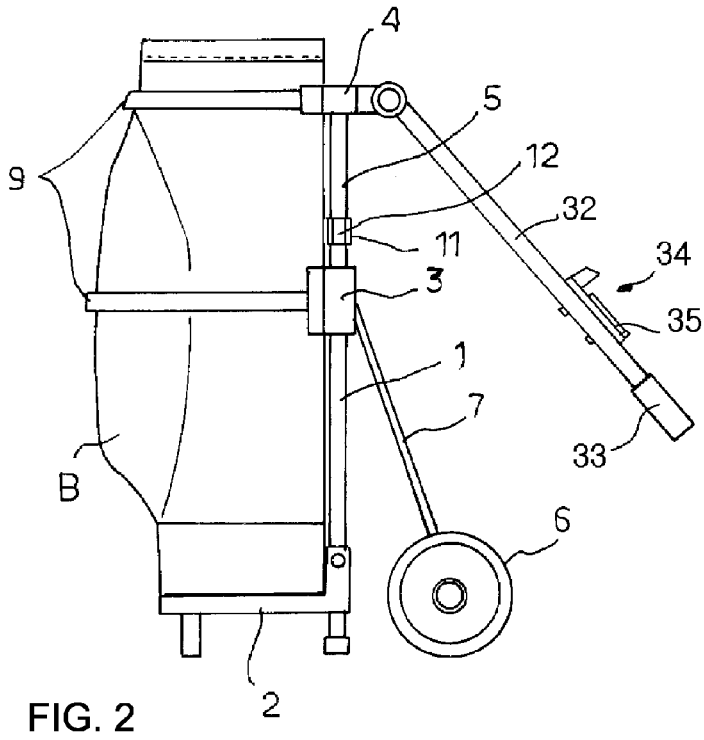
FIG. 2 is a side view of the golf bag carrier of FIG. 1, when a golf bag is loaded on the golf bag carrier.

FIGS. 1 and 2 are respectively perspective and side views of a golf bag carrier according to an embodiment of the present invention.

Referring to FIGS. 1 and 2, a golf bag carrier of an embodiment includes a supporting plate 2 that is coupled to a lower end of a vertical bar 1 by a folding unit such that it is unfolded when the golf bag B is loaded and is folded when the golf bag B is unloaded, a first support 3 that is fixedly installed on an upper portion of the vertical bar 1 to support the golf bag B, and an elevating bar 5 that is coupled to an upper end of the vertical bar 1 by a height adjusting unit. Second supports 4 for supporting an upper and lower ends of the golf bag B is installed on a lower end of the vertical bar 1 and an upper end of the elevating bar 5.

In addition, wheel supports 7 that is pivotally coupled to the first support 3 and can be fixed at folded and unfolded positions by a fixing unit. Wheels 6 are mounted on lower ends of the wheel supports 7. Each of the second supports 4 has a fixing band 9 on which magic tapes 8 are attached.

Figure 3:
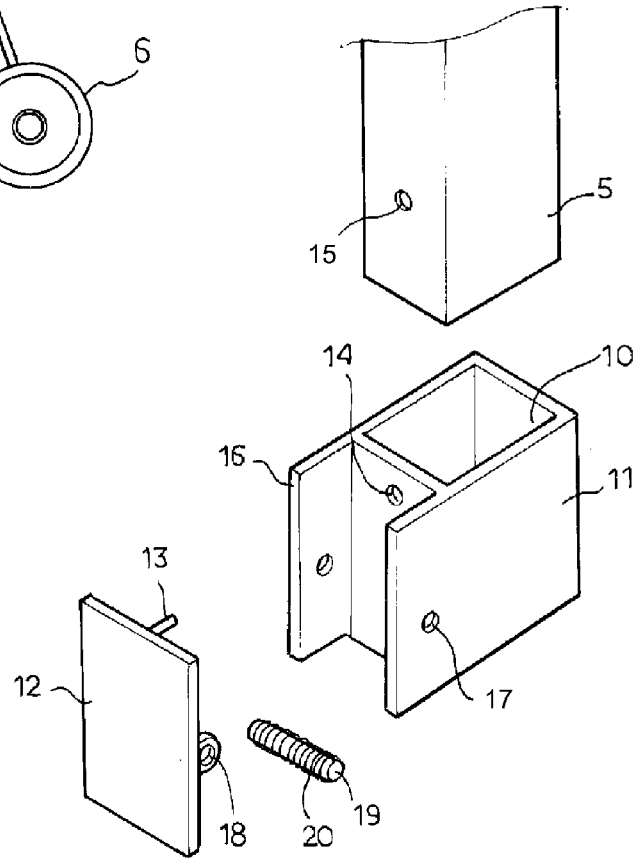
FIG. 3 is an exploded perspective view of an elevating unit of a vertical bar of FIG. 2.

As shown in FIG. 3, the height adjusting unit includes a coupling member 11 that is fitted in an upper end of the vertical bar 1 and is provided with a through hole 10 allowing the hollow vertical bar 1 is inserted to be capable of ascending and descending, and a button 12 that is coupled to a side surface of the coupling member 11 by a hinge unit. The elevating bar 5 is provided with a stopper hole 15 in which the fixing protrusion 13 is inserted through a fixing hole 14 formed on the coupling member 11 to fix the elevating bar 5.

The hinge unit includes coupling portions 16 formed on one surface of the coupling member 11 and facing each other, a hinge hole 17 formed on the coupling unit 16, a hinge portion 18 formed on the button 12, a hinge shaft 19 that is inserted through the hinge hole 17 and the hinge portion 18 to rotate the button 12, and a spring 20 installed on the hinge shaft 19 to disallow the fixing protrusion 12 to contact the elevating bar 5.

Figure 4:
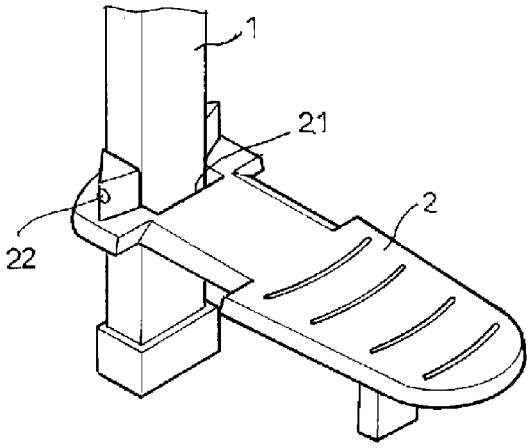
FIG. 4 is a bottom perspective view of a supporting unit of FIG. 2.
Figure 5:
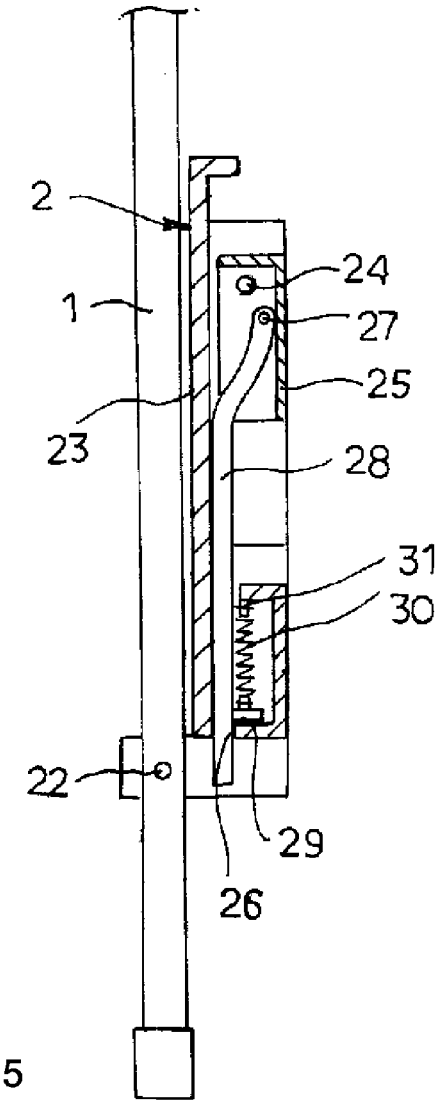
FIG. 5 is a cross-sectional view of FIG. 4.

In addition, as shown in FIGS. 4 and 5, the folding unit includes a fitting groove 21 in which the vertical bar 1 is fitted and which is formed on the supporting plate 2 and a rotational shaft 22 that is installed to rotate the fitting groove 21 in the fitting groove 21.

Figure 6:
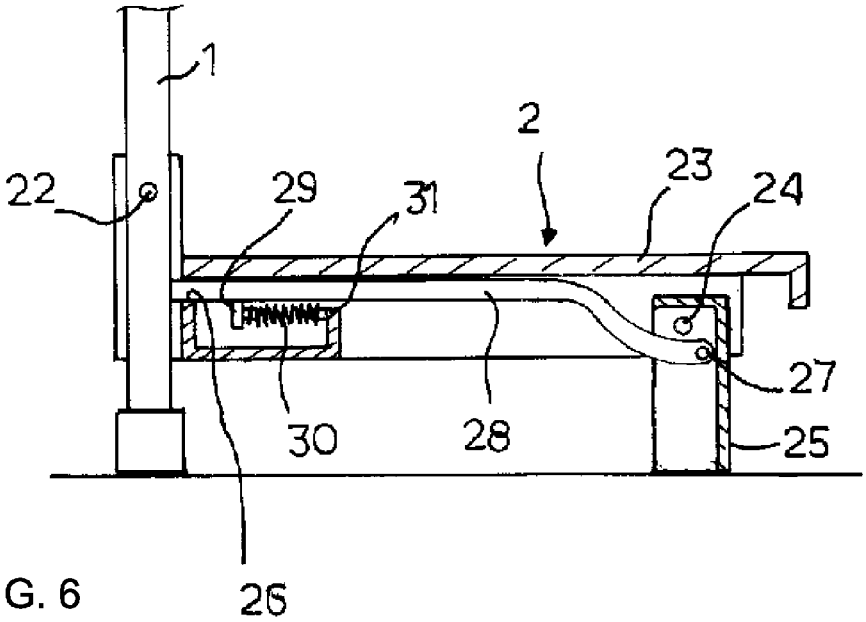
FIG. 6 is a cross-sectional view similar to FIG. 5, when a supporting member protrudes while a supporting unit is unfolded.
Figure 7:
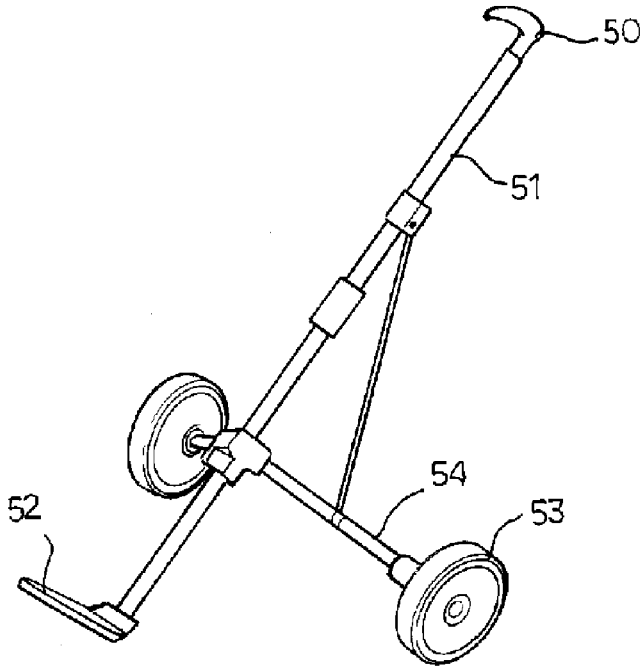
FIG. 7 is a side view of a golf bag carrier according to a related art.

Particularly, a supporting unit that, when the supporting plate 2 is unfolded, supports the supporting plate 2 to space the supporting plate 2 from the ground is installed on the folding unit and the vertical bar 1. The supporting unit, as shown in FIGS. 5 and 6, includes a supporting member 25 that is pivotally installed on a front end of the supporting plate main body 23 by a rotational shaft 24 and spaces the supporting plate 2 from the ground by a predetermined distance when rotating in a vertical direction, a slider 28 that is slidably disposed on an undersurface of the supporting plate main body 23 and has a first end that is reciprocally installed while protruding through the through hole 26 formed on a rear surface of the supporting plate main boy 23 and a second end that is coupled to the supporting member 25 by a hinge shaft to rotate the supporting member 25, and an elastic unit biasing the slider 28 in a direction where the supporting member 25 is folded.

In addition, in order to make the supporting plate 2 be in a horizontal state when the supporting member 25 is unfolded, the rotational shaft is installed at a predetermined height from a lower end of the vertical bar 1.

The elastic unit includes a spring fitting portion 29 protruding from a rear surface of the slider 28, a spring 30 having a first end fitted around the spring fitting portion 29, and a spring fixing portion 31 which is fixed on a lower portion of the supporting plate 2 and around which the spring 30 is fitted. The elastic unit biases the slider 28 leftward in the drawings.

Here, a handle unit 32 is rotatably connected to an upper end of the elevating bar 5 and a handle 33 is formed on a front end of the handle unit 32. A card holder 34 for storing a score card is fixedly installed on the handle unit 32.

The card holder 34 is provided with a cover 35 protecting the score card from rain water.

The following will describe an operational effect of the above-described golf bag carrier.

When the user intends to load the golf bag G on the carrier and move, the user first loads the golf bag G while lowering the supporting plate 2 that was folded.

When the supporting member 25 rotates, the supporting member 25 together with the vertical bar 1 horizontally supports the supporting plate 2. At this point, the spring 30 is in a compressed state between the spring fitting portion 29 and the spring fixing portion 31.

As described above, when the supporting plate 2 is supported by the vertical bar 1 and the supporting member 25 to be spaced apart from the ground in a state where it is unfolded, the bottom surface of the supporting plate 2 is not stained by foreign substances such as soil of the ground and the carrier can maintain a clean state.

When the golf bag G is loaded on the supporting plate 2, the golf bag G is fastened by the fixing bands 9 and the fixing protrusion 13 is released from the stopper hole 15 by pushing the button 12 of the coupling member 11, after which the elevating bar 5 is elevated. In this state, the user grasps the handle and moves the carrier.

At this point, when the elevating bar 5 is elevated up to a predetermined height, the fixing protrusion 13 of the button 12 is inserted into the stopper hole 15 to fix the elevating bar 5.

When the elevating bar 5 is fixed, the wheel supports 7 are unfolded such that the wheels 6 contact the ground, after which the user moves the carrier to a place where he/she plays golf while inclining the golf bag G by a predetermined angle.

As described above, the user can easily carry the golf bag G using the carrier. In order to separate the golf bag G from the carrier after playing golf, the user releases the fixing bands 9 and unloads the golf bag G from the supporting plate 2.

When the golf bag G is unloaded from the supporting plate 2, the slider 28 that has been pushed rightward by the vertical bar 1 in the drawing is biased leftward by the spring 30. Accordingly, as the slider 28 is biased leftward, the supporting plate main body 23 rotates counterclockwise.

When the supporting plate main body 23 rotates counterclockwise, the supporting member 25 connected by the supporting member 25 is inserted into the supporting plate main body 23 and is thus not projected from the vertical bar 1 when being folded.

When the supporting plate 2 closely contacts the vertical bar 1, there is no protruding portion when it is not used and thus it occupies small space. For example, it is convenient to store the carrier in a trunk of a vehicle.

It will be apparent to those skilled in the art that various modifications and variations can be made in the present invention. Thus, it is intended that the present invention covers the modifications and variations of this invention provided they come within the scope of the appended claims and their equivalents.

The invention claimed is:

1. A golf bag carrier comprising:

a vertical bar;

wheels that are installed on the vertical bar that are capable of being folded;

a fixing band that is installed on the vertical bar, the fixing band being capable of securing a golf bag;

a supporting plate that is coupled to a lower end of the vertical bar such that it is unfolded when the golf bag is loaded thereon and automatically folded when the golf bag is unloaded therefrom;

a first support that is fixed at an upper portion of the vertical bar to support the golf bag;

an elevating bar that is coupled to an upper end of the vertical bar by a height adjusting unit; and a second support that is installed to support an upper end of the golf bag.

2. The golf bag carrier of claim 1, wherein the height adjusting unit includes a coupling member that is fitted in an upper end of the vertical bar and is provided with a through hole allowing the hollow vertical bar to ascend and descend, and a button that is coupled to a side surface of the coupling member by a hinge unit, wherein the elevating bar is provided with a stopper hole and the button incorporates a fixing protrusion which is inserted through a fixing hole formed in the coupling member and through the stopper hole to fix the elevating bar in place.

3. The golf bag carrier of claim 2, wherein the hinge unit includes coupling portions formed on one surface of the coupling member and facing each other, a hinge hole formed on the coupling unit, a hinge portion formed on the button, a hinge shaft that is inserted through the hinge hole and the hinge portion to rotate the button, and a spring installed on the hinge shaft to disallow the fixing protrusion to contact the elevating bar when the button is depressed.

4. The golf bag carrier of claim 1, further comprising a folding unit, wherein the folding unit includes a fitting groove in which the vertical bar is fitted and which is formed on the supporting plate, a rotational shaft that is installed to rotate the supporting plate in the fitting groove, and a supporting unit that supports the supporting plate when the supporting plate is unfolded such that the supporting plate is spaced apart from the ground when the supporting unit is in contact with the ground.

5. The golf bag carrier of claim 4, wherein the supporting unit includes a supporting member that is pivotally installed on a front end of a supporting plate main body by a rotational shaft and spaces the supporting plate from the ground by a predetermined distance when rotating in a vertical direction, a slider that is slidably disposed on an undersurface of the supporting plate main body and has a first end that is reciprocally installed while protruding through the through hole formed on a rear surface of the supporting plate main boy and a second end that is coupled to the supporting member by a hinge shaft to rotate the supporting member, and an elastic unit biasing the slider in a direction where the supporting member is folded.

6. The golf bag carrier of claim 5, wherein the elastic unit includes a spring fitting portion protruding from a rear surface of the slider, a spring having a first end fitted around the spring fitting portion, and a spring fixing portion which is fixed on a lower portion of the supporting plate and around which the spring is fitted.

7. The golf bag carrier of claim 2, further comprising a folding unit, wherein the folding unit includes a fitting groove in which the vertical bar is fitted and which is formed on the supporting plate, a rotational shaft that is installed to rotate the supporting plate in the fitting groove, and a supporting unit that supports the supporting plate when the supporting plate is unfolded such that the supporting plate is spaced apart from the ground.

8. The golf bag carrier of claim 3, further comprising a folding unit, wherein the folding unit includes a fitting groove in which the vertical bar is fitted and which is formed on the supporting plate, a rotational shaft that is installed to rotate the supporting plate in the fitting groove, and a supporting unit that supports the supporting plate when the supporting plate is unfolded such that the supporting plate is spaced apart from the ground.

9. A golf bag carrier comprising:

a vertical bar;

wheels that are installed on the vertical bar that are capable of being folded;

a fixing band that is installed on the vertical bar, the fixing band being capable of securing a golf bag;

a supporting plate that is coupled to a lower end of the vertical bar such that it is unfolded when the golf bag is loaded thereon and folded when the golf bag is unloaded therefrom;

a first support that is fixed at an upper portion of the vertical bar to support the golf bag;

an elevating bar that is coupled to an upper end of the vertical bar by a height adjusting unit;

a second support that is installed to support an upper end of the golf bag; and a folding unit, wherein the folding unit includes a fitting groove in which the vertical bar is fitted and which is formed on the supporting plate, a rotational shaft that is installed to rotate the supporting plate in the fitting groove, and a supporting unit that supports the supporting plate when the supporting plate is unfolded such that the supporting plate is spaced apart from the ground, wherein the supporting unit includes a supporting member that is pivotally installed on a front end of a supporting plate main body by a rotational shaft and spaces the supporting plate from the ground by a predetermined distance when rotating in a vertical direction, a slider that is slidably disposed on an undersurface of the supporting plate main body and has a first end that is reciprocally installed while protruding through the through hole formed on a rear surface of the supporting plate main boy and a second end that is coupled to the supporting member by a hinge shaft to rotate the supporting member, and an elastic unit biasing the slider in a direction where the supporting member is folded.

10. The golf bag carrier of claim 9, wherein the height adjusting unit includes a coupling member that is fitted in an upper end of the vertical bar and is provided with a through hole allowing the hollow vertical bar to ascend and descend, and a button that is coupled to a side surface of the coupling member by a hinge unit, wherein the elevating bar is provided with a stopper hole and the button incorporates a fixing protrusion which is inserted through a fixing hole formed in the coupling member and through the stopper hole to fix the elevating bar in place.

11. The golf bag carrier of claim 10, wherein the hinge unit includes coupling portions formed on one surface of the coupling member and facing each other, a hinge hole formed on the coupling unit, a hinge portion formed on the button, a hinge shaft that is inserted through the hinge hole and the hinge portion to rotate the button, and a spring installed on the hinge shaft to disallow the fixing protrusion to contact the elevating bar when the button is depressed.

12. The golf bag carrier of claim 9, wherein the elastic unit includes a spring fitting portion protruding from a rear surface of the slider, a spring having a first end fitted around the spring fitting portion, and a spring fixing portion which is fixed on a lower portion of the supporting plate and around which the spring is fitted.

13. The golf bag carrier of claim 1, wherein the second support is installed on the elevating bar.

14. A golf bag carrier comprising:

a vertical bar;

an elevating bar that is coupled to an upper end of the vertical bar by a height adjusting unit;

a first support that is fixed at an upper portion of the vertical bar to support a golf bag; and a supporting plate that is coupled to a lower end of the vertical bar such that it is unfolded when the golf bag is loaded thereon and automatically folded when the golf bag is unloaded therefrom.

15. The golf bag carrier of claim 14, further comprising wheels that are installed on the vertical bar that are capable of being folded.

16. The golf bag carrier of claim 14, further comprising a fixing band that is installed on the vertical bar, the fixing band being capable of securing the golf bag.

17. The golf bag carrier of claim 14, further comprising a second support that is capable of securing an upper end of the golf bag.

18. The golf bag carrier of claim 17, wherein the second support is installed on the elevating bar.

19. The golf bag carrier of claim 14, further comprising a folding unit, the folding unit comprising a fitting groove in which the vertical bar is fitted and which is formed on the supporting plate, a rotational shaft that is installed to rotate the supporting plate in the fitting groove, and a supporting unit that supports the supporting plate when the supporting plate is unfolded such that the supporting plate is spaced apart from the ground when the supporting unit is in contact with the ground.

20. The golf bag carrier of claim 19, wherein the supporting unit includes a supporting member that is pivotally installed on a front end of a supporting plate main body by a rotational shaft and spaces the supporting plate from the ground by a predetermined distance when rotating in a vertical direction, a slider that is slidably disposed on an undersurface of the supporting plate main body and has a first end that is reciprocally installed while protruding through the through hole formed on a rear surface of the supporting plate main boy and a second end that is coupled to the supporting member by a hinge shaft to rotate the supporting member, and an elastic unit biasing the slider in a direction where the supporting member is folded.

* * * * *